US011243492B2

(12) United States Patent
Kawajiri

(10) Patent No.: US 11,243,492 B2
(45) Date of Patent: Feb. 8, 2022

(54) IMAGE FORMING APPARATUS

(71) Applicant: SHARP KABUSHIKI KAISHA, Sakai (JP)

(72) Inventor: Kazuki Kawajiri, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/240,873

(22) Filed: Apr. 26, 2021

(65) Prior Publication Data

US 2021/0364975 A1 Nov. 25, 2021

(30) Foreign Application Priority Data

May 20, 2020 (JP) ..... JP2020-088201

(51) Int. Cl.
*G03G 21/08* (2006.01)
*G03G 21/00* (2006.01)

(52) U.S. Cl.
CPC ..... *G03G 21/08* (2013.01); *G03G 21/0094* (2013.01)

(58) Field of Classification Search
CPC ..... G03G 21/08; G03G 21/06; G03G 21/0094
See application file for complete search history.

(56) References Cited

U.S. PATENT DOCUMENTS

2016/0282752 A1* 9/2016 Oi ..... G03G 21/08
2017/0010556 A1* 1/2017 Noguchi ..... G03G 21/08
2017/0315464 A1* 11/2017 Oi ..... G03G 15/0189

FOREIGN PATENT DOCUMENTS

JP 2001-042715 A 2/2001
JP 2017-181878 A 10/2017

* cited by examiner

*Primary Examiner* — Walter L Lindsay, Jr.
*Assistant Examiner* — Jessica L Eley
(74) *Attorney, Agent, or Firm* — ScienBiziP, P.C.

(57) ABSTRACT

An image forming apparatus includes: a photosensitive drum; a light guide plate that irradiates, onto the photosensitive drum, light incoming through an end thereof by emitting the light from an irradiation end surface thereof; a static elimination light source that is disposed near the end of the light guide plate and emits the light into the light guide plate; and a blocking wall that is disposed between the light guide plate and the photosensitive drum to cover the irradiation end surface, and restricts the light emitted from the irradiation end surface non-uniformly in a longitudinal direction of the light guide plate. Of the light emitted from the irradiation end surface, portions emitted from end regions located around ends of the light guide plate are less restricted by the blocking wall than a portion emitted from a region other than the end regions of the light guide plate.

8 Claims, 12 Drawing Sheets

IMAGE FORMING APPARATUS

BACKGROUND OF THE INVENTION

Field of the Invention

The present invention relates to an image forming apparatus that performs static elimination on a photosensitive drum using light.

Description of the Background Art

It is conventional to eliminate static from a photosensitive drum by irradiating the photosensitive drum with light from a static elimination lamp in image forming apparatuses such as copiers, facsimile machines, printers, and multifunction peripherals. An image forming apparatus includes, for example, an image forming unit (image former), a transfer device, and a fixing device as an image forming mechanism. The image forming unit forms a toner image. The toner image formed is transferred onto paper. The fixing device fixes the transferred toner image to the paper. The paper having the image formed thereon is ejected out of the image forming apparatus.

The image forming unit has a photosensitive drum, a development device, and the like. An electrostatic latent image is formed on the photosensitive drum and developed into a toner image, and the toner image is transferred from the photosensitive drum onto paper. After the toner image has been transferred onto the paper, the photosensitive drum is irradiated with light (static elimination light) from a static elimination lamp to reduce the potential of the photosensitive drum. Thus, static is eliminated from the photosensitive drum, so that a next electrostatic latent image can be formed thereon.

Preferably, a static elimination device including the static elimination lamp performs the static elimination using light having a uniform dose distribution by uniformly irradiating static elimination light onto the photosensitive drum, so that image degradation can be prevented or reduced. Various techniques have been disclosed regarding such a static elimination device.

For example, Japanese Unexamined Patent Application Publication No. 2001-042715 discloses an image forming apparatus including a light path restriction member that restricts static elimination light emitted by a static elimination lamp from being irradiated onto ends of a photosensitive drum.

For another example, Japanese Unexamined Patent Application Publication No. 2017-181878 discloses a static elimination device including: a light source; a light guide member having an end surface (one end surface) that receives incoming light from the light source and an end surface (opposite end surface) opposite to the one end surface; a reflective member that causes the light emitted from the opposite end surface of the light guide member to re-enter the light guide member; and a holding member that holds an opposite end surface-ward end of the light guide member. The light guide member includes, on a surface thereof located away from an image bearing member, a reflective portion that extends in an axial direction and reflects the light incoming through the one end surface. The light guide member also includes a light emission surface which faces the image bearing member and from which the light reflected by the reflective portion is emitted toward the image bearing member. The light guide member has a static elimination region where the light emitted from the light emission surface is irradiated onto the image bearing member and a light-blocking region where the holding member blocks the light emitted from the light emission surface. The static elimination region and the light-blocking region are adjacent to each other in the axial direction. The reflective portion continuously spans across the static elimination region and at least a portion of the light-blocking region.

The image forming apparatus disclosed in Japanese Unexamined Patent Application Publication No. 2001-042715 and the static elimination device disclosed in Japanese Unexamined Patent Application Publication No. 2017-181878 are aimed at uniform static elimination on the photosensitive drum (image bearing member) and reduction of image degradation. Other than the inventions disclosed in Japanese Unexamined Patent Application Publication No. 2001-042715 and Japanese Unexamined Patent Application Publication No. 2017-181878, inventions aimed at uniform static elimination on photosensitive drums have been proposed.

However, the conventional image forming apparatus and the conventional static elimination device described above are not sufficient in terms of uniform static elimination, and an image forming apparatus that achieves higher performance has been desired. In the case of a recent less-expensive model of image forming apparatus including a charging roller, in particular, a light guide plate having a Fresnel pitch is used with a single light source provided at one end thereof, in terms of cost reduction. However, it is difficult to apply such a light guide plate having a Fresnel pitch to the invention disclosed in Japanese Unexamined Patent Application Publication No. 2001-042715. It is possible to apply a light guide plate having a Fresnel pitch to the invention disclosed in Japanese Unexamined Patent Application Publication No. 2017-181878. However, it is difficult to achieve a uniform dose distribution on the image bearing member, and therefore chargeability of the image bearing member tends to be non-uniform in portions around ends thereof.

The present invention has been made in view of the circumstances described above, and an object thereof is to provide an image forming apparatus that achieves cost reduction, static elimination on a photosensitive drum with light having a uniform dose distribution, and prevention or reduction of image degradation.

SUMMARY OF THE INVENTION

An image forming apparatus according to an embodiment of the present invention includes: a photosensitive drum; a light guide plate that is disposed with a longitudinal direction thereof being substantially parallel to an axial direction of the photosensitive drum and that irradiates, onto the photosensitive drum, static elimination light incoming through an end thereof by emitting the static elimination light from an irradiation end surface thereof, the irradiation end surface of the light guide plate being a surface facing the photosensitive drum; a light source that emits the static elimination light into the light guide plate, the light source being disposed in the vicinity of the end of the light guide plate; and a blocking member that restricts the static elimination light emitted from the irradiation end surface in a non-uniform manner in the longitudinal direction of the light guide plate, the blocking member being disposed between the light guide plate and the photosensitive drum, and covering the irradiation end surface, wherein the static elimination light emitted from the irradiation end surface includes static elimination light emitted from end regions located around ends of the light guide plate and static elimination light emitted to a central region being a region other than the end regions of the light guide plate, and the static elimination light emitted from the end regions is less restricted by the blocking member than the static elimination light emitted from the central region.

According to this configuration, the static elimination light emitted from the irradiation end surface is irradiated onto the photosensitive drum after being restricted by the blocking member. Portions of the static elimination light emitted from end regions located around ends of the light guide plate are less restricted by the blocking member than a portion emitted to a central region being a region other than the end regions of the light guide plate. According to this configuration, the static elimination light irradiated onto the photosensitive drum achieves a more uniform dose distribution throughout a length of the photosensitive drum in the axial direction (longitudinal direction) of the photosensitive drum. This reduces non-uniformity in chargeability of the photosensitive drum and image unevenness that can occur during image formation.

In the image forming apparatus described above, the blocking member may be a blocking wall having a height that varies according to locations in the longitudinal direction, and being disposed substantially parallel to the axial direction of the photosensitive drum between the light source and the photosensitive drum, and the blocking wall may restrict the static elimination light emitted from the irradiation end surface by blocking the static elimination light.

According to this configuration, the blocking wall restricts the static elimination light emitted from the irradiation end surface. Thus, it is possible to restrict the static elimination light more reliably with a simple configuration.

In the image forming apparatus described above, the height of the blocking wall may be higher in a portion corresponding to the central region than in portions corresponding to the end regions.

According to this configuration, the degree of the restriction on the static elimination light emitted from the irradiation end surface is higher in the central region than in the end regions. Thus, the static elimination light irradiated onto the photosensitive drum achieves a more uniform dose distribution throughout the length of the photosensitive drum in the axial direction (longitudinal direction) of the photosensitive drum. This reduces non-uniformity in chargeability of the photosensitive drum and image unevenness that can occur during image formation.

In the image forming apparatus described above, the blocking wall may be stair-like and have a plurality of levels of height, and boundaries between the different levels of height may be vertical.

This configuration makes it possible to accurately set the restriction on the static elimination light to a desired degree for each of the regions that are different in the height of the blocking wall. It is therefore possible to achieve a desired dose distribution throughout the length of the photosensitive drum in the axial direction (longitudinal direction) of the photosensitive drum.

In the image forming apparatus described above, the end regions may not be provided with the blocking wall.

The structure according to this configuration that eliminates the need for the blocking wall in the end regions allows for a reduction in cost for manufacturing the blocking wall. Since the end regions are not provided with the blocking wall, the static elimination light in these regions can be efficiently used, avoiding a waste of the static elimination light, and thus reducing power consumption.

The image forming apparatus described above may further include a housing that accommodates the light guide plate therein, the housing having an opening in a side thereof facing the photosensitive drum. In this configuration, the blocking wall may be provided on an edge of the opening of the housing, the blocking wall may not be provided around ends of the housing, and the edge of the opening may have grooves around the ends of the housing to widen the opening.

According to this configuration, the opening is widened at ends of the edge, thereby reducing the restriction on the static elimination light. It is therefore possible to use the static elimination light efficiently. Since the opening is widened by forming the grooves in the housing, a common housing may be used for different models by forming grooves as necessary. The use of the common housing for different models allows for mass production of the housing, achieving cost reduction.

In the image forming apparatus described above, the blocking wall may be provided with a reflective member on a surface thereof facing the irradiation end surface, and the reflective member diffusely reflects light.

According to this configuration, a portion of the static elimination light emitted from the irradiation end surface is diffusely reflected by the reflective member, and the resulting scattered light is reflected off the irradiation end surface and re-emitted from the irradiation end surface. Repetition of such light emission from the irradiation end surface reduces non-uniformity in light emitted from the irradiation end surface that can occur in a light guide plate having a Fresnel pitch. Thus, it is possible to reduce occurrence of a defect such as a fringe pattern in an image formed.

In the image forming apparatus described above, the height of the blocking wall may be at a highest level in a location corresponding to a dose peak in a dose distribution of the static elimination light irradiated onto the photosensitive drum from the light source without the blocking wall, and the height of the blocking wall may be determined according to the dose distribution.

According to this configuration, it is possible to achieve an optimal height of the blocking wall. Thus, the static elimination light irradiated onto the photosensitive drum achieves a more uniform dose distribution throughout the length of the photosensitive drum in the axial direction (longitudinal direction) of the photosensitive drum. This reduces non-uniformity in chargeability of the photosensitive drum and image unevenness that can occur during image formation.

According to the present invention, it is possible to provide an image forming apparatus that achieves cost reduction, static elimination on a photosensitive drum with light having a uniform dose distribution, and prevention or reduction of image degradation.

DESCRIPTION OF THE PREFERRED EMBODIMENTS

Embodiment 1

Figure 1:
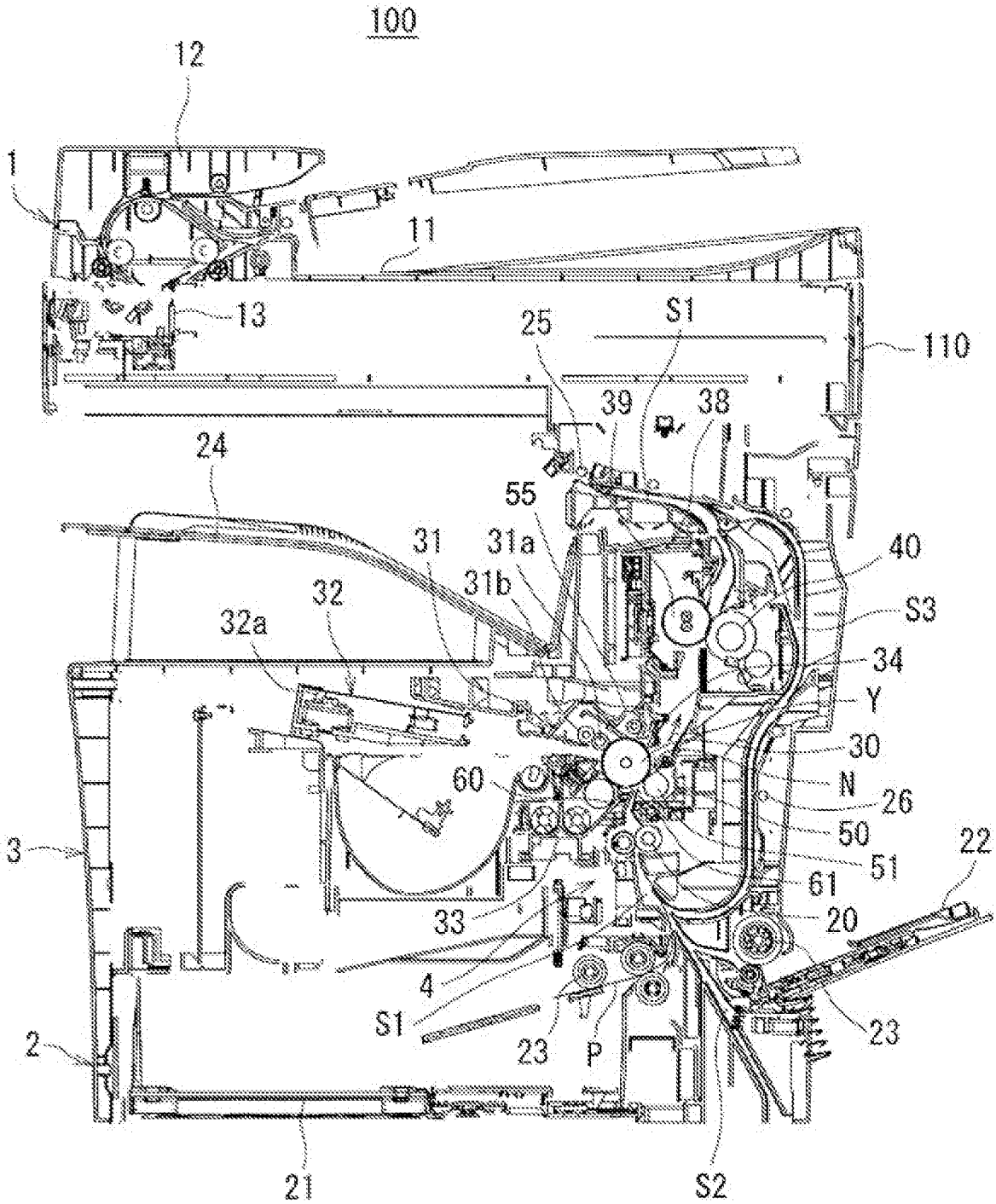
FIG. 1 is a schematic cross-sectional view of an image forming apparatus according to Embodiment 1 of the present invention.

The following describes Embodiment 1 of the present invention in detail with reference to the accompanying drawings. FIG. 1 is a schematic cross-sectional view of an image forming apparatus 100 according to Embodiment 1 of the present invention.

The image forming apparatus 100 according to Embodiment 1 is an electrophotographic image forming apparatus, and includes an image reader 1, an image former 3 disposed under the image reader 1, and a paper feeder 2 disposed under the image former 3 as illustrated in FIG. 1.

The image reader 1 includes a document table 11 including transparent glass, an automatic document feeder (ADF) 12 that automatically feeds a document onto the document table 11, and a document image reader 13 that scans and reads an image of the document placed on the document table 11. The image former 3 is provided in an image forming apparatus main body 110. The image former 3 includes a photosensitive drum 30 (image bearing member) and various constituent elements disposed around the photosensitive drum 30 for performing an electrophotographic process.

The image former 3 includes the photosensitive drum 30, a charger 31, an exposure device 32, a developing device 33, a transfer device 50, a static eliminator 34, and a cleaner 55.

The charger 31, the exposure device 32, the developing device 33, the transfer device 50, the static eliminator 34, and the cleaner 55 are provided around the photosensitive drum 30 in the stated order.

The charger 31 uniformly charges a surface of the photosensitive drum 30 to a predetermined potential through application of a direct-current (DC) voltage. The charger 31 includes a charging roller 31*a* and a charger cleaning roller 31*b*. Only a direct-current voltage component excluding an alternating-current voltage component is applied to the charging roller 31*a*. The charging roller 31*a* passively rotates in accompaniment to rotation (surface movement) of the photosensitive drum 30 while in contact with the surface of the photosensitive drum 30. The charger cleaning roller 31*b* cleans a surface of the charging roller 31*a*. The charger cleaning roller 31*b* passively rotates in accompaniment to rotation (surface movement) of the charging roller 31*a* while in contact with the surface of the charging roller 31*a*.

The exposure device 32 emits image writing light modulated based on image data from a laser light source 32*a* toward the photosensitive drum 30. More specifically, the exposure device 32 (laser light source 32*a*) irradiates the surface of the photosensitive drum 30 rotating and being uniformly charged to the predetermined potential with the image writing light while scanning the image writing light in a main scanning direction. Thus, the exposure device 32 can write a latent image (electrostatic latent image) on the photosensitive drum 30.

The developing device 33 makes visible the latent image formed on the photosensitive drum 30 with a toner. The developing device 33 causes a charged toner to adhere to the latent image formed on the photosensitive drum 30 by the exposure device 32. By thus making visible the latent image on the photosensitive drum 30, the developing device 33 can develop the latent image into a toner image.

The transfer device 50 electrostatically transfers the toner image formed on the photosensitive drum 30 onto paper P such as image transfer paper. The transfer device 50 includes a transfer roller 51 (transfer member). The transfer roller 51 passively rotates in accompaniment to the rotation (surface movement) of the photosensitive drum 30 while in contact with the surface of the photosensitive drum 30. A transfer bias (voltage) is applied to the transfer roller 51.

The static eliminator 34 eliminates residual potential remaining on the photosensitive drum 30 after the image transfer. The static eliminator 34 is located downstream of the transfer device 50 and upstream of the charger 31 in a rotation direction of the photosensitive drum 30. In the present example, the static eliminator 34 is disposed between the transfer device 50 and the cleaner 55. The static eliminator 34 eliminates residual potential remaining on the photosensitive drum 30 by irradiating the surface of the photosensitive drum 30 with light (static elimination light), as described in detail below.

The cleaner 55 removes residual toner remaining on the photosensitive drum 30 after the image transfer without being transferred by the transfer device 50. The residual toner removed by the cleaner 55 is collected in a waste toner collection container (not shown) disposed between a front cabinet of the image forming apparatus 100 and the image former 3.

As illustrated in FIG. 1, the image former 3 includes a fixing device 38. After the toner image has been transferred onto the paper P by the transfer device 50, the fixing device 38 fixes the toner image to the paper P through heating. The fixing device 38 includes a heating roller 39 and a fixing roller 40. The heating roller 39 is heated to a predetermined fixing temperature. The fixing roller 40 is pressed against the heating roller 39 at a predetermined fixing pressure. Thus, the fixing device 38 can fuse the toner image on the paper P using the heat from the heating roller 39 and fix the toner image to the paper P using the fixing pressure of the fixing roller 40 exerted on the heating roller 39.

The image forming apparatus 100 further includes the paper feeder 2 and a transporter 4. The paper feeder 2 includes a paper feed cassette 21 and a manual paper feed tray 22 as a plurality of paper feed devices. The image forming apparatus 100 selects one paper feed device from the paper feed cassette 21 and the manual paper feed tray 22. Furthermore, the image forming apparatus 100 separately transports the paper P to the transporter 4 one sheet at a time using a pickup roller 23 for the selected paper feed device. The transporter 4 includes a registration roller 20, an ejection roller 25, and a transport roller 26. The registration roller 20 transports, in a transport direction Y, the paper P sent thereto from the paper feeder 2 toward a transfer nip N. The registration roller 20 stays at rest before the paper P is sent thereto. The registration roller 20 is driven to start rotating such that the electrostatic latent image on the photosensitive drum 30 and an image formation area (area other than a void (margin) area) of the paper P coincide when the paper P abuts the transfer nip N.

The image forming apparatus 100 includes transport paths S1 and S2, an inverting transport path S3, and a catch tray 24. Through the transport paths S1 and S2, the paper P is transported from the paper feeder 2 to the image former 3, and the paper P having the toner image fixed thereto is transported to the catch tray 24. The inverting transport path S3 is used for duplex printing. After the paper P having the toner image printed on a front side thereof has turned around at the ejection roller 25, the inverting transport path S3 guides the paper P back to the registration roller 20 with the front and back sides of the paper P inverted. Thus, the image forming apparatus 100 can form a toner image on the back side of the paper P as well as on the front side in duplex printing. Transport rollers for transporting the paper P are disposed in appropriate positions in the vicinity of the transport paths S1 and S2, and the inverting transport path S3.

The image forming apparatus 100 according to Embodiment 1 has pre-transfer paper guides 60 and 61 between the registration roller 20 and the transfer nip N. The pre-transfer paper guide 60, which guides a printing side of the paper P, is held by the developing device 33. Note here that "the pre-transfer paper guide 60 being held by the developing device 33" encompasses both a configuration in which a housing of the developing device 33 itself is used as the pre-transfer paper guide 60 and a configuration in which the pre-transfer paper guide 60 being a separate member is supported on the housing of the developing device 33. As a result of the pre-transfer paper guide 60 being held by the developing device 33, the positional accuracy between the photosensitive drum 30 and a tip of the pre-transfer paper guide 60 increases, reducing streaks and banding that can occur due to impact. The pre-transfer paper guide 60 being held by the developing device 33 also contributes to a reduction in size of the image forming apparatus 100.

In the case where the housing of the developing device 33 itself is used as the pre-transfer paper guide 60, the pre-transfer paper guide 60 is made from a resin (for example, polycarbonate/acrylonitrile-butadiene-styrene (PC/ABS) resin), which is the same material as the housing of the developing device 33. Likewise, in the case where the pre-transfer paper guide being a separate member is supported on the housing of the developing device 33, the pre-transfer paper guide 60 is preferably made from a resin. In the present embodiment, the pre-transfer paper guide 60 is made from a resin.

Figure 2:
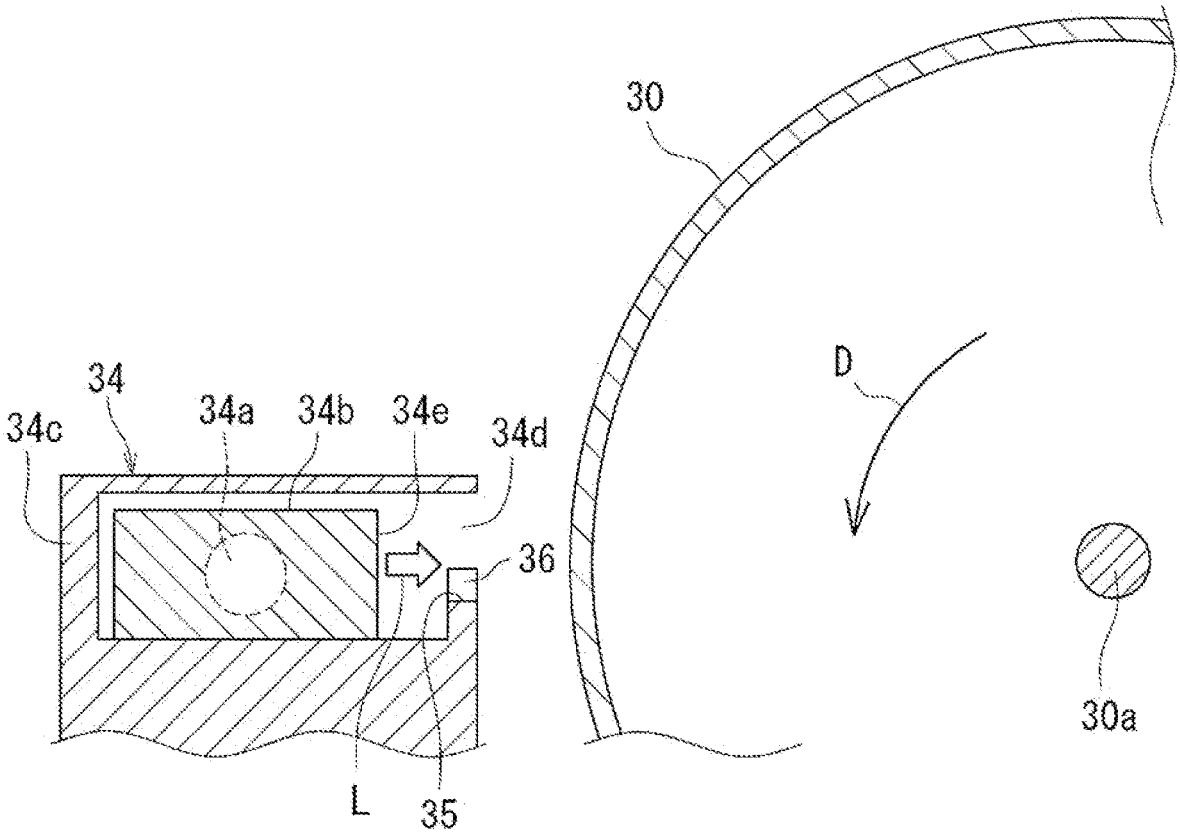
FIG. 2 is an enlarged schematic cross-sectional view for illustrating an arrangement of a photosensitive drum and a static eliminator in the image forming apparatus according to Embodiment 1 of the present invention.
Figure 3:
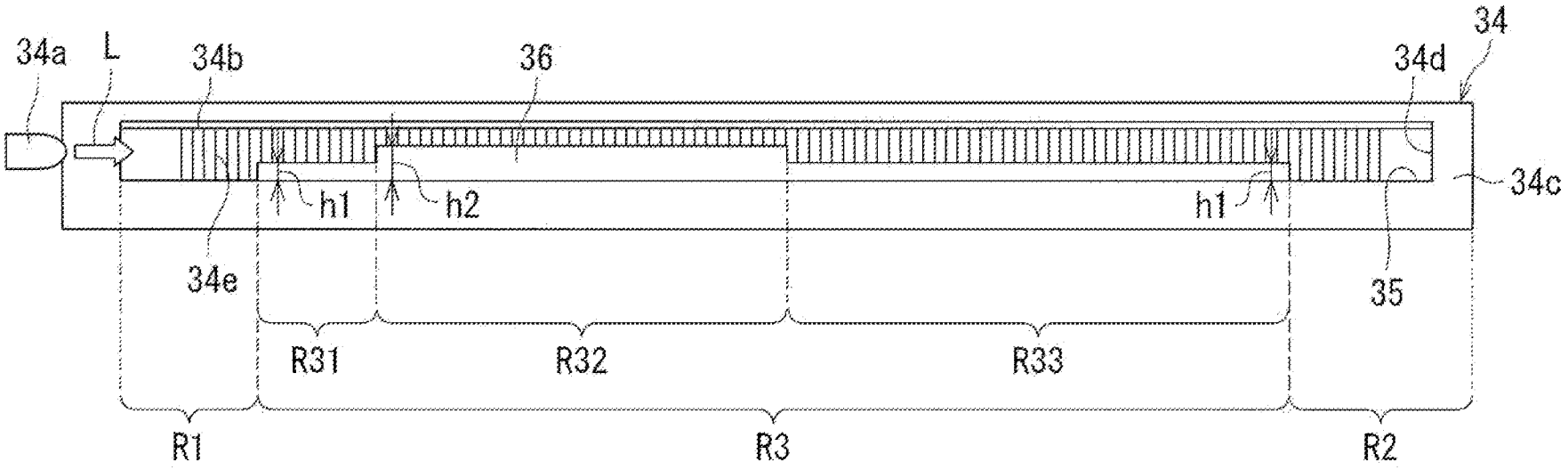
FIG. 3 is a schematic view of the static eliminator as seen in a direction from the photosensitive drum to the static eliminator in the image forming apparatus according to Embodiment 1 of the present invention.

The following describes the static eliminator 34 in detail with reference to the drawings. FIG. 2 is an enlarged schematic cross-sectional view for illustrating an arrangement of the photosensitive drum 30 and the static eliminator 34 in the image forming apparatus 100 according to Embodiment 1 of the present invention. FIG. 3 is a schematic view of the static eliminator 34 as seen in a direction from the photosensitive drum 30 to the static eliminator 34 in the image forming apparatus 100 according to Embodiment 1 of the present invention.

As illustrated in FIGS. 2 and 3, the static eliminator 34 includes a static elimination light source 34*a*, a light guide plate 34*b*, and a housing 34*c* accommodating the light guide plate 34*b*. The housing 34*c* has an opening 34*d* in a side thereof facing the photosensitive drum 30. The light guide plate 34*b* herein has a configuration having a Fresnel pitch and is disposed substantially parallel to the photosensitive drum 30. Specifically, a longitudinal direction of the light guide plate 34*b* is substantially parallel to a rotation axis 30*a* of the photosensitive drum 30. Note that the photosensitive drum 30 and the light guide plate 34*b* each have a shape that is elongate in a direction perpendicular to the plane in FIG. 2.

As in the case of the light guide plate 34*b*, a longitudinal direction of the housing 34*c* is substantially parallel to the rotation axis 30*a* (axial direction) of the photosensitive drum 30 since the housing 34*c* accommodates the light guide plate 34*b*. The static elimination light source 34*a* is disposed in the vicinity of one end of the light guide plate 34*b*. As described above, the housing 34*c* has the opening 34*d* in the side thereof facing the photosensitive drum 30. Note that a blocking wall 36 is provided on an edge 35 of the opening 34*d*. The blocking wall 36 has a height that varies according to locations in the longitudinal direction of the photosensitive drum 30. That is, the blocking wall 36 is disposed between the light guide plate 34*b* and the photosensitive drum 30. Thus, as described in detail below, the blocking wall 36 closes the opening 34*d*, and light L emitted from the light guide plate 34*b* is irradiated onto the photosensitive drum 30 after being restricted in a non-uniform manner in the longitudinal direction of the light guide plate 34*b*. Since the photosensitive drum 30 rotates in the rotation direction D, the entirety of the outer circumferential surface of the photosensitive drum 30 is irradiated with the light L.

The static elimination light source 34*a* emits the light L toward the light guide plate 34*b*. The static elimination light source 34*a* is, for example, a light-emitting element such as a light-emitting diode (LED). The light L, which is static elimination light emitted from the static elimination light source 34*a*, enters the light guide plate 34*b* through an end surface of the light guide plate 34*b*. The light L that has entered the light guide plate 34*b* is then emitted toward the photosensitive drum 30 from an irradiation end surface 34*e* facing the opening 34*d* of the housing 34*c*. The light L emitted from the irradiation end surface 34*e* passes through the opening 34*d* to reach the photosensitive drum 30. The blocking wall 36 herein is disposed between the light guide plate 34*b* and the photosensitive drum 30 so as to cover the irradiation end surface 34*e*, and thus the light L emitted from the irradiation end surface 34*e* is irradiated onto the photosensitive drum 30 after being restricted by the blocking wall 36.

Note that in order to irradiate the photosensitive drum 30 throughout a length thereof in the longitudinal direction with the light emitted from the light guide plate 34*b*, the light guide plate 34*b* (irradiation end surface 34*e*) has a length in the longitudinal direction on par with (substantially equal to)

the longitudinal length of the photosensitive drum 30, the light guide plate 34*b* and the photosensitive drum 30 are opposed to each other, and the light L is emitted toward the photosensitive drum 30 from the entirety of the irradiation end surface 34*e*. Since the light L is emitted toward the photosensitive drum 30 from the irradiation end surface 34*e* of the light guide plate 34*b* as described above, the light L in FIG. 3 is emitted from the irradiation end surface 34*e* in a direction perpendicular to the plane in FIG. 3, which in other words is in a direction away from the plane in FIG. 3.

As a result of the light L emitted by the static elimination light source 34*a* being irradiated onto the photosensitive drum 30 through the light guide plate 34*b*, residual potential remaining on the photosensitive drum 30 is eliminated. Note that it is preferable that the static elimination on the photosensitive drum 30 be uniform. Non-uniform static elimination can adversely affect image formation and degrade the resulting image. It is therefore preferable that the dose distribution of the light L (static elimination light) on the photosensitive drum 30 be uniform.

As illustrated in FIG. 3 the blocking wall 36 has a height that varies according to locations. Specifically, regions R1 and R2 are not provided with the blocking wall 36. That is, the blocking wall 36 has a height of "0" in the regions R1 and R2. The blocking wall 36 has a height of h1 in regions R31 and R33, and a height of h2 in a region R32 out of a region R3 provided with the blocking wall 36. The height satisfies the relationship represented by h1<h2.

That is, the blocking wall 36 has a plurality of levels of height, and is therefore stair-like. Boundaries between the regions that are different in the height of the blocking wall 36 are vertical. Specifically, the boundary between the regions R1 and R31, the boundary between the regions R31 and R32, the boundary between the regions R32 and R33, and the boundary between the regions R33 and R2 each extend in a vertical direction. Note here that the regions R1 and R2 are end regions located around ends of the light guide plate 34*b*. Since the photosensitive drum 30 and the light guide plate 34*b* have substantially the same length and are opposed to each other as described above, the photosensitive drum 30 has equivalent regions corresponding to those of the light guide plate 34*b*. That is, the regions R1 and the R2 can be described as end regions located at ends of the photosensitive drum 30. Likewise, the region R3 (regions R31, R32, and R33) can be described as a central region, which is a region other than the end regions at the ends of the photosensitive drum 30.

As described above, the light L emitted from the irradiation end surface 34*e* to be irradiated onto the photosensitive drum 30 is restricted by the blocking wall 36 while passing through the opening 34*d*. The degree of the restriction has a proportionate relationship to the height of the blocking wall 36. Specifically, the degree of the restriction is lower in the regions R1 and R2 where the height of the blocking wall 36 is "0" than in the regions R31 and R33 where the height of the blocking wall 36 is h1. The degree of the restriction is lower in the regions R1 and R2 than in the region R32 where the height of the blocking wall 36 is h2. The degree of the restriction is lower in the regions R31 and R33 where the height of the blocking wall 36 is h1 than in the region R32 where the height of the blocking wall 36 is h2.

Reducing the degree of the restriction on the light L to be emitted from the irradiation end surface 34*e* by setting the height of the blocking wall 36 in the regions R1 and R2 to a lower level than in the region R3 (regions R31, R32, and R33) as described above allows for irradiation of the photosensitive drum 30 with the light L achieving a more uniform dose distribution throughout the length of the photosensitive drum 30 in the longitudinal direction of the photosensitive drum 30. The region R32 where the height of the blocking wall 36 is at the highest level is a region including a portion of the photosensitive drum 30 to be irradiated with the largest dose of light if the light L is irradiated without the blocking wall 36. Setting the height of the blocking wall 36 in the region R32 to a highest level allows for irradiation of the photosensitive drum 30 with the light L achieving a more uniform dose distribution throughout the length of the photosensitive drum 30 in the longitudinal direction of the photosensitive drum 30. Generally, the dose peak in dose distribution is located toward the end facing the static elimination light source 34*a* away from a center of the photosensitive drum 30 in the longitudinal direction.

In Embodiment 1, as described above, setting the degree of the restriction on the light L to be emitted from the irradiation end surface 34*e* to a lower level in the regions R1 and R2, which are the end regions located around the ends of the light guide plate 34*b*, than in the other region, which is the region R3, allows for irradiation of the photosensitive drum 30 with the light L achieving a more uniform dose distribution throughout the length of the photosensitive drum 30 in the longitudinal direction of the photosensitive drum 30. This reduces non-uniformity in chargeability of the photosensitive drum 30 and image unevenness that can occur during the image formation on the paper P. As described above, it is preferable to set the height of the blocking wall 36 to a highest level to increase the degree of the restriction in the region R32, which is a region including a portion of the photosensitive drum 30 to be irradiated with the largest dose of light if the light L is irradiated without the blocking wall 36. This configuration allows for irradiation of the photosensitive drum 30 with the light L achieving a more uniform dose distribution throughout the length of the photosensitive drum 30 in the longitudinal direction of the photosensitive drum 30, and thus reduces non-uniformity in chargeability of the photosensitive drum 30 and image unevenness that can occur during the image formation on the paper P.

In some cases, a common component is applied to different models of image forming apparatuses, because mass production of components and the like results in cost reduction. In a case where common components (for example, the static elimination light source 34*a*, the light guide plate 34*b*, and the housing 34*c*) are applied to different models of image forming apparatuses, the dose distribution of the light L to be irradiated onto the photosensitive drum 30 can be different between the different models. However, non-uniformity in the dose distribution in each model can be reduced by employing the blocking wall 36 specific to the model. That is, the blocking wall 36 for each model is given a configuration specific to the model by changing the height, the regions different in height, and the like, while common components are used as the static elimination light source 34*a*, the light guide plate 34*b*, the housing 34*c*, and the like, allowing for cost reduction through mass production of such components.

The following describes the static eliminator 34 of the image forming apparatus 100 according to Embodiment 1 using Example 1. Note that the following particularly describes the blocking wall 36.

Example 1

Figure 4:
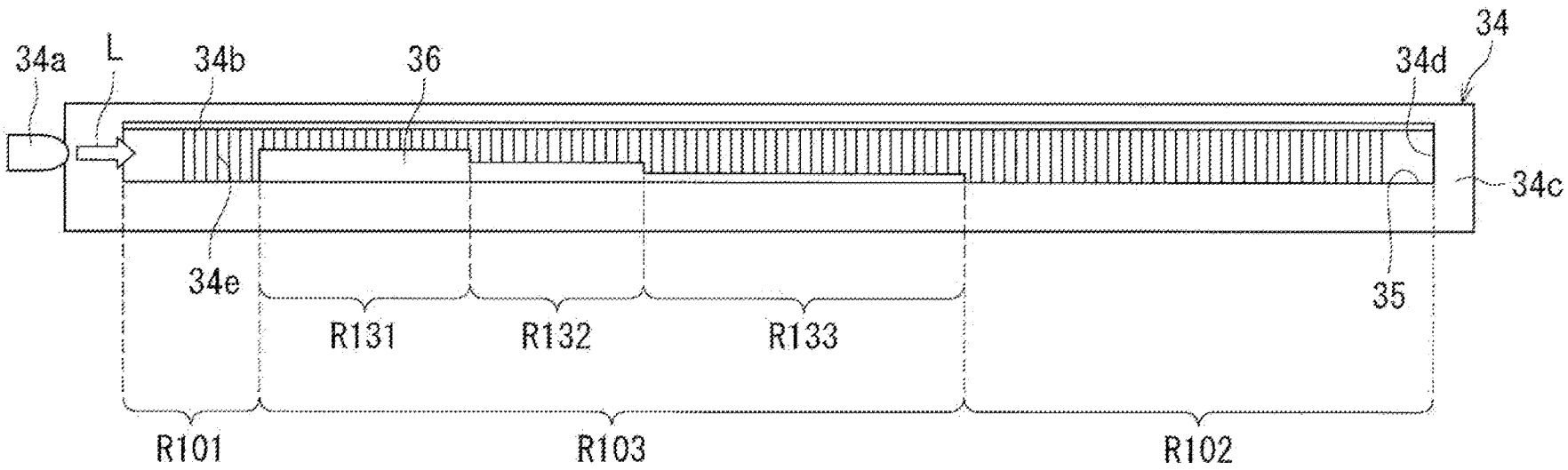
FIG. 4 is a schematic view illustrating a configuration of a static eliminator according to Example 1 of the present invention as seen in a direction from a photosensitive drum to the static eliminator.
Figure 5:
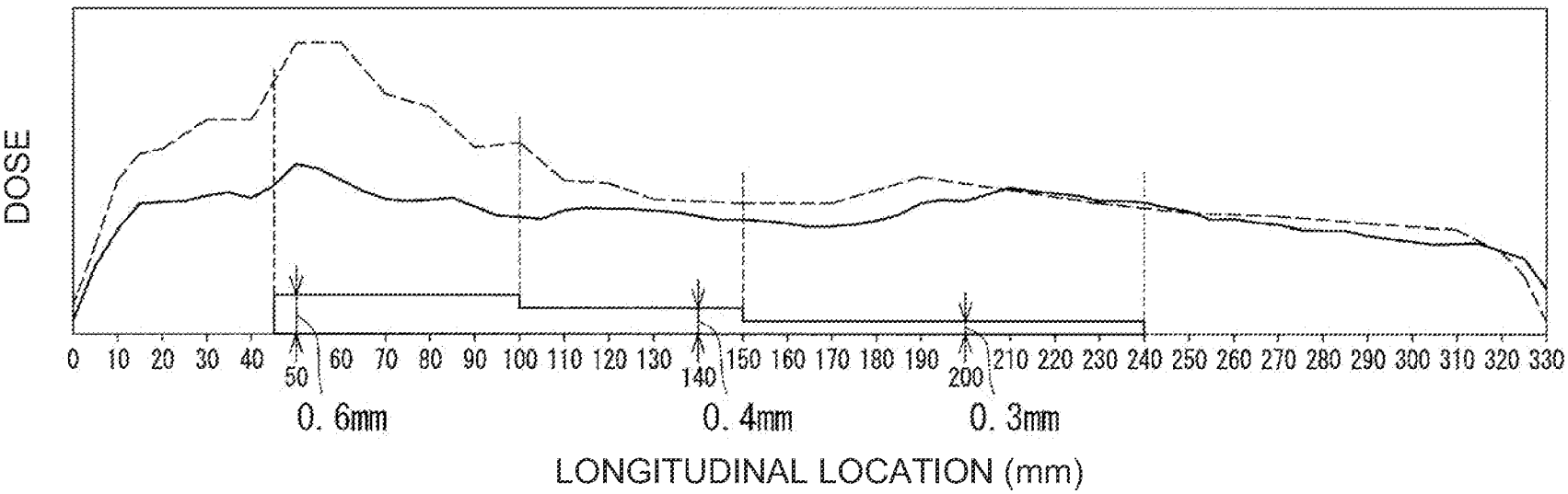
FIG. 5 is a diagram showing dose distribution of light irradiated onto the photosensitive drum according to Example 1 of the present invention.

FIG. 4 is a schematic view illustrating a configuration of a static eliminator 34 according to Example 1 of the present invention as seen in a direction from the photosensitive drum 30 to the static eliminator 34. FIG. 5 is a diagram showing dose distribution of light L irradiated onto a photosensitive drum 30 according to Example 1 of the present invention. Note that components that have the same function and operation as the components that have already been described are labelled using the same reference signs, and detailed description thereof is omitted.

As illustrated in FIG. 4, the static eliminator 34 of an image forming apparatus 100 according to Example 1 has a blocking wall 36 disposed on an edge 35 of a housing 34*c*. Regions R101 and R102, which are end regions located around ends of a light guide plate 34*b*, are not provide with the blocking wall 36 on the edge 35, whereas a region R103, which is a central region located between the regions R101 and R102, is provided with the blocking wall 36. The region R103 is divided into regions R131, R132, and R133, where the blocking wall 36 has a height that varies from region to region. Note that the blocking wall 36 illustrated in FIG. 4 has a different shape from the blocking wall 36 illustrated in FIG. 3. That is, the height of the blocking wall 36 progressively decreases in the order of the region R131, which is the closest region to the static elimination light source 34*a*, the region R132, and the region R133.

In FIG. 5, the horizontal axis represents location in a longitudinal direction of the light guide plate 34*b*, and the vertical axis represents dose of the light L irradiated onto the photosensitive drum 30 from each location in the longitudinal direction of the light guide plate 34*b*. The light L irradiated onto the photosensitive drum 30 herein means light that is emitted out of the static eliminator 34, which is specifically light that is emitted from an irradiation end surface 34*e*, and then directly irradiated onto the photosensitive drum 30 through the opening 34*d*.

A graph in a dashed line in FIG. 5 represents dose distribution of the light L that was irradiated ono the photosensitive drum 30 in a configuration including no blocking wall 36. A graph in a solid line represents dose distribution of the light L that was irradiated onto the photosensitive drum 30 in a configuration including the blocking wall 36. As shown in FIG. 5, the blocking wall 36 has a height of 0.6 mm in a region (region R131) ranging from a location at a distance of 45 mm to a location at a distance of 100 mm from an end of the light guide plate 34*b* facing the static elimination light source 34*a*, a height of 0.4 mm in a region (region R132) ranging from a location at a distance of 100 mm to a location at a distance of 150 mm from the end of the light guide plate 34*b* facing the static elimination light source 34*a*, and a height of 0.3 mm in a region (region R133) ranging from a location at a distance of 150 mm to a location at a distance of 240 mm from the end of the light guide plate 34*b* facing the static elimination light source 34*a*. Note that a region (region R101) ranging from a location at a distance of 0 mm to a location at a distance of 50 mm and a region (region R102) ranging from the location at a distance of 240 mm to a location at a distance of 330 mm from the end of the light guide plate 34*b* facing the static elimination light source 34*a* are not provided with the blocking wall 36. That is, the blocking wall 36 has a height of 0 mm in these regions.

As shown in FIG. 5, the configuration including no blocking wall 36 resulted in a non-uniform dose distribution that is uneven in the longitudinal direction. However, FIG. 5 indicates that the blocking wall 36 reduced unevenness in dose distribution in the longitudinal direction and improved uniformity thereof. The height of the blocking wall 36 may be determined by obtaining dose distribution without the blocking wall 36, setting the height of the blocking wall 36 to a highest level in a region including a location having a dose peak, and then setting the height of the blocking wall 36 in the other regions according to variation of the dose. Preferably, compared to the height of the blocking wall 36 in the end regions located around the ends of the light guide plate 34*b*, the height of the blocking wall 36 is set to a higher level in a central region, which is a region other than the end regions and is located between the end regions.

Through the above, Example 1 has been described. However, the image forming apparatus 100 according to Embodiment 1 may have a configuration other than as described above. For example, the dose distribution also changes depending on the dose of the light L at the time when the light L is emitted from the static elimination light source 34*a* and the angle of the light L emitted from the static elimination light source 34*a*. It is therefore preferable to determine the configuration of the blocking wall 36 according to the dose distribution.

In a case where the longitudinal location of the peak of the dose distribution in the configuration including no blocking wall 36 is toward the end facing the static elimination light source 34*a* away from the longitudinal center of the light guide plate 34*b*, for example, the blocking wall 36 may take any of the following first to third forms.

In the first form, the height of the blocking wall 36 is set to a highest level in a region corresponding to the peak and to a lower level in two regions having the region corresponding to the peak therebetween, and one of the two regions that is closer to the static elimination light source 34*a* has a smaller range than the other of the two regions that is farther from the static elimination light source 34*a*.

In the second form, the height of the blocking wall 36 is set to a highest level in a region corresponding to the peak and to a lower level in two regions having the region corresponding to the peak therebetween, and each of the two regions is divided into a plurality of regions having a plurality of levels of height of the blocking wall 36. Furthermore, the number of levels of height of the blocking wall 36 (the number of regions different in height) is smaller in one of the two regions that is closer to the static elimination light source 34*a* than in the other of the two regions that is farther from the static elimination light source 34*a*.

In the third form, the height of the blocking wall 36 is set to a highest level in a region corresponding to the peak and to a lower level in two regions having the region corresponding to the peak therebetween, and each of the two regions is divided into a plurality of regions having a plurality of levels of height of the blocking wall 36. Furthermore, the range of each of the regions in the two regions is set so that the farther from the static elimination light source 34*a* the region is, the larger the range thereof is. In this case, the two regions are other than regions respectively including the ends of the light guide plate 34*b*. That is, the two regions are regions located inward of the regions (outermost regions) respectively including the ends of the light guide plate 34*b*.

In a case where the longitudinal location of the peak of the dose distribution in the configuration including no blocking wall 36 is toward the end opposite to the static elimination light source 34*a* away from the longitudinal center of the light guide plate 34*b*, for example, the blocking wall 36 may take any of forms respectively achieved through inversion of the first to third forms described above at the longitudinal center.

In a case where the longitudinal location of the peak of the dose distribution in the configuration including no blocking wall 36 is at the longitudinal center of the light guide plate 34*b*, for example, the blocking wall 36 may take a form in which the height of the blocking wall 36 is set to a highest level in a region corresponding to the peak, the region corresponding to the peak is located at the longitudinal center, and the height of the blocking wall 36 in each of the other regions is set so that the farther from the longitudinal center the region is, the lower the height of the blocking wall 36 in the region is, and thus the blocking wall 36 has a symmetrical shape with respect to the longitudinal center.

The image forming apparatus 100 according to Embodiment 1 has been described above. However, the present invention is not limited to the configuration described above. For example, as described with reference to FIG. 3, the boundary between the regions R1 and R31, the boundary between the regions R31 and R32, the boundary between the regions R32 and R33, and the boundary between the regions R33 and R2 each extend in the vertical direction in the configuration described above, but may alternatively each extend at an angle to the vertical direction.

Figure 6:
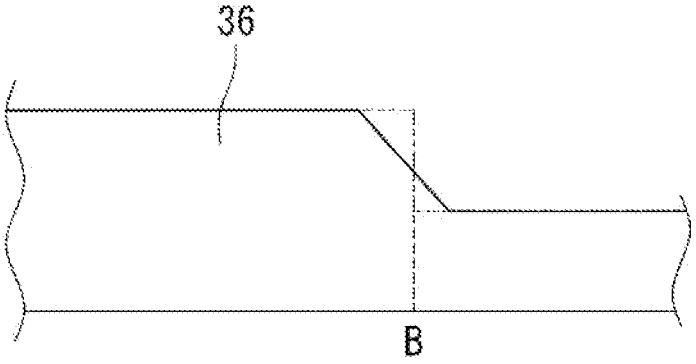
FIG. 6 is an enlarged schematic view of a form of a blocking wall in the image forming apparatus according to Embodiment 1 of the present invention.

FIG. 6 is an enlarged schematic view of another form of the blocking wall 36 in the image forming apparatus 100 according to Embodiment 1 of the present invention. As illustrated in FIG. 6, the height of the blocking wall 36 may gradually change in an inclined manner according to longitudinal locations around a boundary B between regions different in height. Note that the blocking wall 36 is linearly inclined around the boundary B in FIG. 6, but the inclination may alternatively be in a curved line.

Preferably, the inside of the housing 34*c* is white in order for the light L that has entered the light guide plate 34*b* from the static elimination light source 34*a* to be diffusely reflected. However, the inside of the housing 34*c* is not limited to being white, and may alternatively be black. Alternatively, the inside of the housing 34*c* may be black and a portion thereof may be white. For example, at least portions of the inside of the housing 34*c* that are located around the ends of the light guide plate 34*b* may be white. This configuration promotes reflection of the light L, and thus improves uniformity of the light L to be irradiated onto the photosensitive drum 30 in the longitudinal direction.

Embodiment 2

The following describes an image forming apparatus according to Embodiment 2 of the present invention with reference to the drawings. Note that components that have the same function and operation as the components that have already been described are labelled using the same reference signs, and detailed description thereof is omitted.

Figure 7:
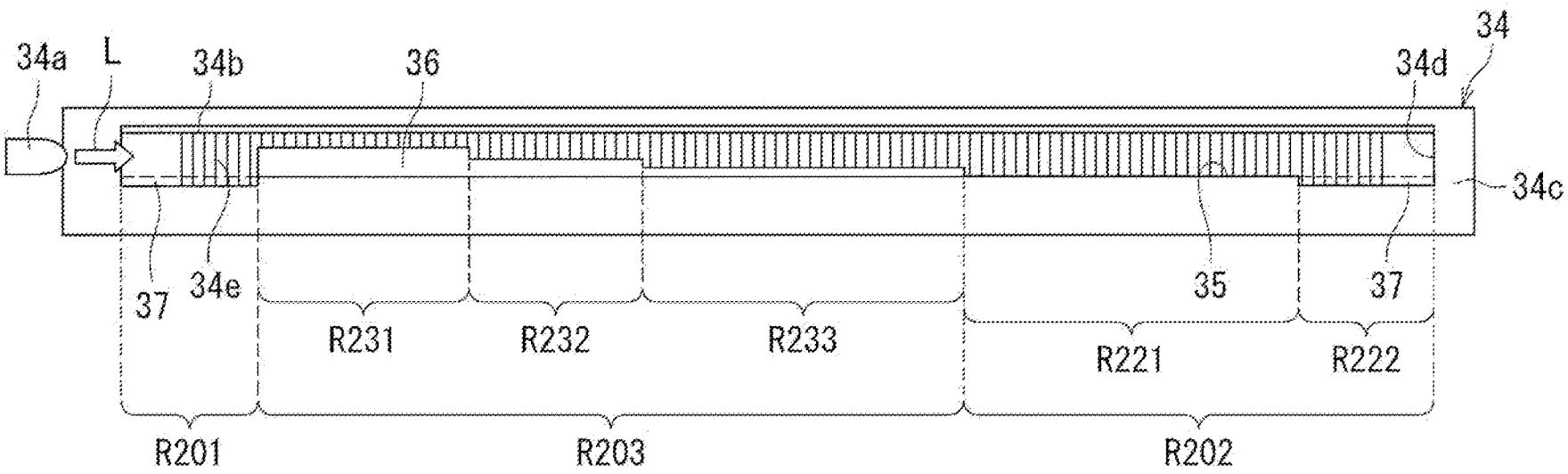
FIG. 7 is a schematic view of a static eliminator as seen in a direction from a photosensitive drum to the static eliminator in an image forming apparatus according to Embodiment 2 of the present invention.

FIG. 7 is a schematic view of a static eliminator 34 as seen in a direction from a photosensitive drum 30 to the static eliminator 34 in an image forming apparatus 100 according to Embodiment 2 of the present invention. The static eliminator 34 in Embodiment 2 has the same configuration as the static eliminator 34 in Embodiment 1 except that an edge 35 of a housing 34*c* in Embodiment 2 further has grooves 37 in portions thereof corresponding to ends of a light guide plate 34*b*.

The edge 35 of the housing 34*c* further includes the grooves 37 in the portions thereof corresponding to the ends of the light guide plate 34*b* as illustrated in FIG. 7. That is, an opening 34*d* is widened in these portions by, for example, cutting or otherwise processing the edge 35. Specifically, the opening 34*d* is widened by forming the groove 37 in a portion of the edge 35 in a region R201 located around the end of the light guide plate 34*b* facing a static elimination light source 34*a*. A region R202 located around the other end of the light guide plate 34*b* that is farther from the static elimination light source 34*a* is divided into regions R221 and R222. The opening 34*d* is also widened by forming the groove 37 in a portion of the edge 35 in the region R222 closer to the other end of the light guide plate 34*b*. This configuration reduces restriction on the light L to be emitted from an irradiation end surface 34*e* in the regions R201 and R222, and thus increases the dose of the light L to be emitted from the static eliminator 34. That is, the thus formed grooves 37 widen the opening 34*d*, reduce restriction on the light L to be emitted from the irradiation end surface 34*e* in the regions R201 and R222 respectively located at the ends of the light guide plate 34*b*, and thus increase the dose of the light L to be irradiated onto the photosensitive drum 30.

Furthermore, a blocking wall 36 is provided in a region R203 being a central region located between the regions R201 and R202. The region R203 is divided into regions R231, R232, and R233, where the blocking wall 36 has a height that varies from region to region.

Generally, the dose of the light L emitted from regions around the ends of the light guide plate 34*b* is lower than the dose of the light L emitted from the other regions. The dose of the light L to be emitted can therefore be increased by forming the grooves 37 as described above, and thus widening the opening 34*d* in the portions around the ends of the light guide plate 34*b*.

For example, the opening 34*d* may be widened by forming the grooves 37 in the edge 35 as described above to ensure a sufficient dose of the light L around the ends of the light guide plate 34*b* in a case where the dose distribution of the light L on the photosensitive drum 30 obtained by providing the blocking wall 36 on the edge 35 is not sufficiently uniform throughout a length of the photosensitive drum 30 in a longitudinal direction of the photosensitive drum 30. The thus widened opening 34*d* allows for irradiation of the photosensitive drum 30 with the light L achieving a more uniform dose distribution throughout the length of the photosensitive drum 30 in the longitudinal direction of the photosensitive drum 30, reducing non-uniformity in chargeability of the photosensitive drum 30 and image unevenness that can occur during image formation on paper P.

This configuration may also be applied to a case where common components are used in different models of image forming apparatuses. That is, in a case where the dose distribution of the light L obtained by employing a different blocking wall 36 for each of the models is not sufficiently uniform throughout the length of the photosensitive drum 30 in the longitudinal direction of the photosensitive drum 30, the grooves 37 may be formed to ensure a sufficient dose of the light L at the ends, and thus to achieve a more uniform dose distribution throughout the length of the photosensitive drum 30 in the longitudinal direction of the photosensitive drum 30. This eliminates the need for producing a different housing 34*c* for each model. That is, a common housing 34*c* can be used for different models by forming the grooves 37, achieving cost reduction.

The following describes the static eliminator 34 of the image forming apparatus 100 according to Embodiment 2 using Example 2. Note that the following particularly describes a portion of a blocking wall 36 around an end of a light guide plate 34*b* facing a static elimination light source 34*a*.

Example 2

Figure 8:
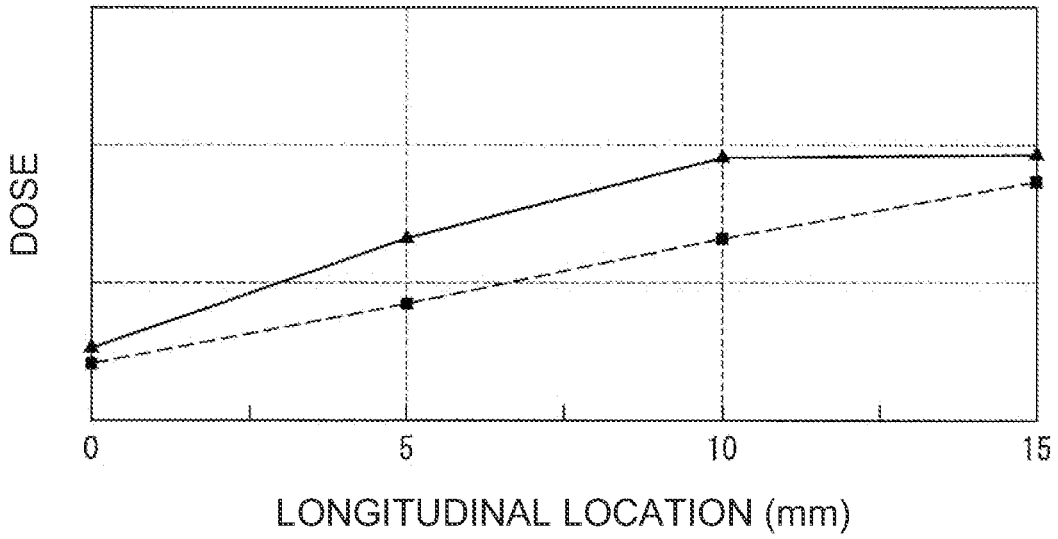
FIG. 8 is a diagram showing dose distribution of light irradiated onto a photosensitive drum according to Example 2 of the present invention.

FIG. 8 is a diagram showing dose distribution of light L irradiated onto a photosensitive drum 30 according to Example 2 of the present invention. Note that FIG. 8 shows the dose distribution in a range from a longitudinal location at a distance of 0 mm to a longitudinal location at a distance of 15 mm from the end of the light guide plate 34*b* facing the static elimination light source 34*a*. This range is equivalent to the region R201 in FIG. 7. The static eliminator 34 according to Example 2 is equivalent to the static eliminator 34 illustrated in FIG. 7.

In FIG. 8, the horizontal axis represents location in a longitudinal direction of the light guide plate 34*b*, and the vertical axis represents dose of the light L irradiated onto the photosensitive drum 30 from each location in the longitudinal direction of the light guide plate 34*b*. The light L irradiated onto the photosensitive drum 30 herein means light that is emitted out of the static eliminator 34, which is specifically light that is emitted from an irradiation end surface 34*e*, and then directly irradiated onto the photosensitive drum 30 through the opening 34*d*.

A graph in a dashed line in FIG. 8 represents dose distribution of the light L that was irradiated ono the photosensitive drum 30 without any grooves 37 in the edge 35. A graph in a solid line represents dose distribution of the light L that was irradiated onto the photosensitive drum 30 with a groove 37 having a depth of 0.4 mm provided in a portion of the edge 35 in the range at 0 mm to 15 mm from the end facing the static elimination light source 34*a*. That is, the groove 37 is in the range (region R201 in FIG. 7) from the longitudinal location at a distance of 0 mm to the longitudinal location at a distance of 15 mm from the end facing the static elimination light source 34*a*. As a result of the groove 37 having a depth of 0.4 mm being formed in the edge 35, the edge 35 has a height of 0.4 mm relative to the groove 37.

FIG. 8 indicates that the formation of the groove 37 resulted in an increase in the dose. The increase in the dose of the light L irradiated onto the photosensitive drum 30 as a result of the formation of the groove 37 is approximately 1.5 times the dose in the case of a configuration having no groove 37.

Figure 9:
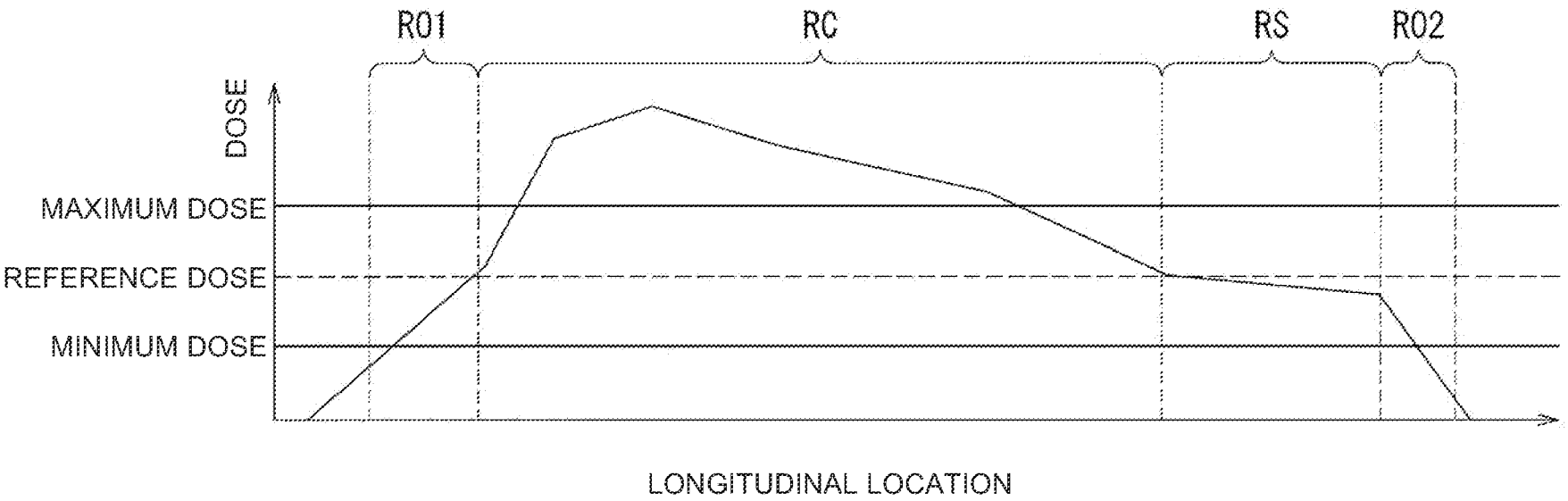
FIG. 9 is a diagram showing dose distribution of light that was irradiated onto the photosensitive drum without a blocking wall and grooves for determining configurations of the blocking wall and the grooves in the image forming apparatus according to Embodiment 2 of the present invention.
Figure 10:
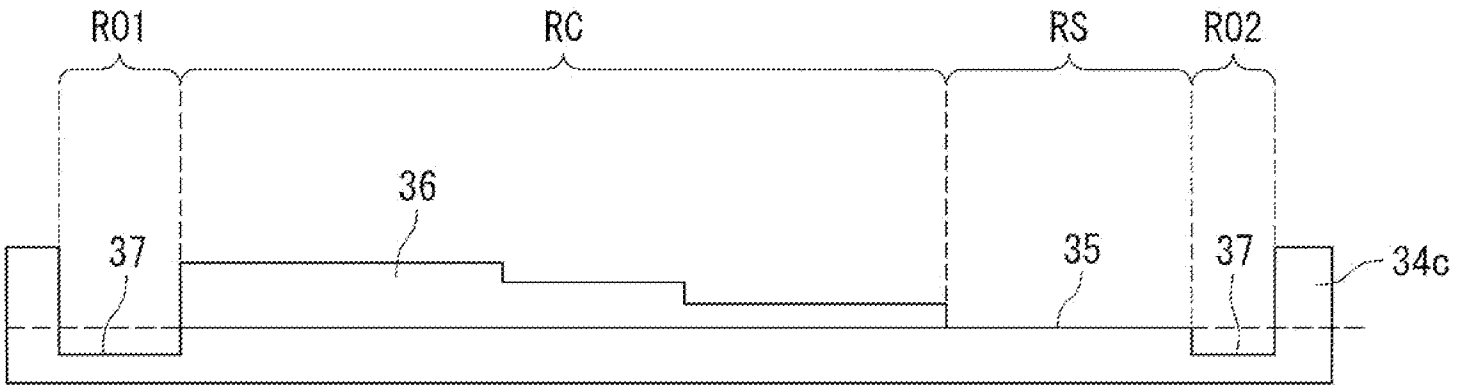
FIG. 10 is a schematic view of configurations of the blocking wall and the grooves determined based on FIG. 9.
Figure 11:
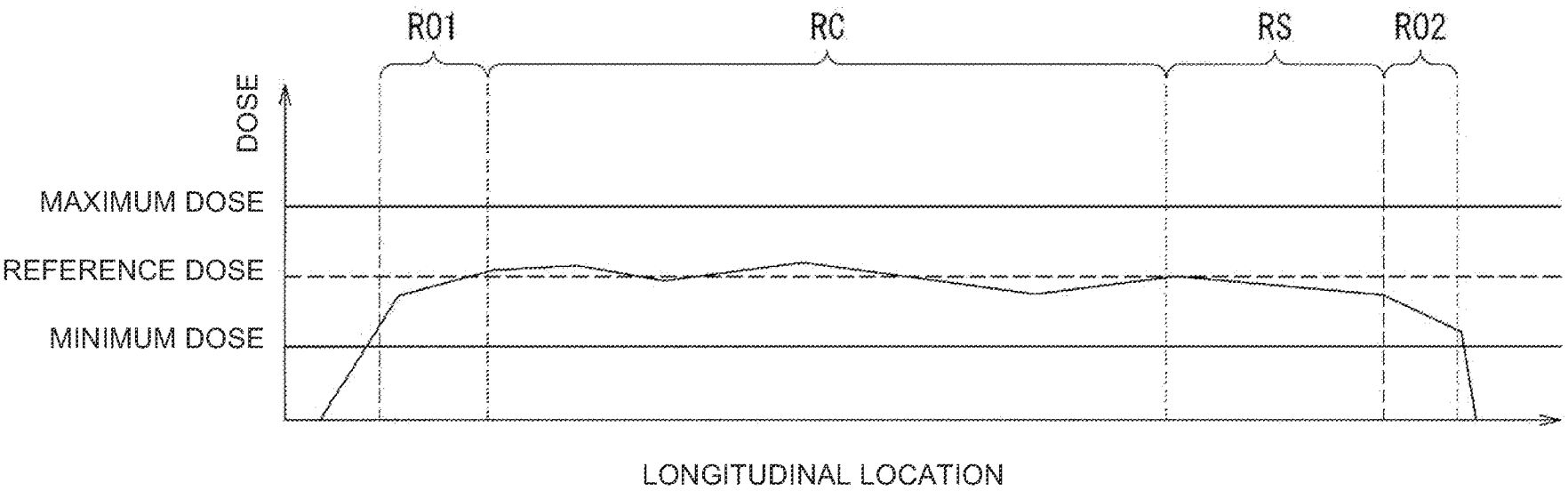
FIG. 11 is a diagram showing dose distribution of light that was irradiated onto the photosensitive drum after the blocking wall and the grooves illustrated in FIG. 10 had been formed.

The following next describes a method for determining the height of the blocking wall 36 in each region and the depth of the grooves 37 with reference to the drawings. FIG. 9 is a diagram showing dose distribution of the light L that was irradiated onto the photosensitive drum 30 without the blocking wall 36 and the grooves 37 for determining configurations of the blocking wall 36 and the grooves 37 in the image forming apparatus 100 according to Embodiment 2 of the present invention. FIG. 10 is a schematic view of configurations of the blocking wall 36 and the grooves 37 determined based on FIG. 9. FIG. 11 is a diagram showing dose distribution of the light L that was irradiated onto the photosensitive drum 30 after the blocking wall 36 and the grooves 37 illustrated in FIG. 10 had been formed.

Note that in FIGS. 9 and 11, the horizontal axis represents location in the longitudinal direction of the light guide plate 34*b*, and the vertical axis represents dose of the light L irradiated onto the photosensitive drum 30 from each location in the longitudinal direction of the light guide plate 34*b*. The light L irradiated onto the photosensitive drum 30 herein means light that is emitted out of the static eliminator 34, which is specifically light that is emitted from the irradiation end surface 34*e*, and then directly irradiated onto the photosensitive drum 30 through the opening 34*d*.

Preferably, the height of the blocking wall 36 in each region and the depth of the grooves 37 are determined in consideration of reducing deterioration of the photosensitive drum 30 due to light fatigue as well as achieving a more uniform dose distribution of the light L to be irradiated onto the photosensitive drum 30. Note here that charging and static elimination on the photosensitive drum 30 are performed by causing charge transfer in an organic film in the photosensitive drum 30 through irradiation of the photosensitive drum 30 with light, and thus controlling the potential of the photosensitive drum 30. The chargeability of the photosensitive drum 30 decreases as charging and static elimination are repeated on the photosensitive drum 30. In particular, the higher the dose of the light L irradiated onto the photosensitive drum 30 is, the more the chargeability of the photosensitive drum 30 decreases. It is therefore preferable to irradiate the light L onto the photosensitive drum 30 in a dose that allows sufficient static elimination on the photosensitive drum 30 and that reduces the decrease in the chargeability to a greater extent.

That is, it is preferable to set the height of the blocking wall 36 in each region and the depth of the grooves 37 so as to obtain a more uniform dose distribution of the light L on the photosensitive drum 30 for sufficient static elimination and reduce deterioration of the photosensitive drum 30 due to light fatigue.

In order to determine the height of the blocking wall 36 in each region and the depth of the grooves 37, the dose distribution of the light L is obtained first by irradiating the light L onto the photosensitive drum 30 without the blocking wall 36 and the grooves 37 in the edge 35 as illustrated in FIG. 9. Note here that in FIG. 9, a maximum dose refers to a maximum amount of light in an allowable light fatigue range, and a minimum dose refers to a minimum amount of light necessary to perform sufficient static elimination. Note that the maximum dose and the minimum dose vary from model to model, and are therefore determined in advance by performing measurements for each model of the image forming apparatus 100. A value intermediate between the maximum dose and the minimum dose is determined as a reference dose.

A range where the dose is substantially equal to the reference dose in FIG. 9 does not need to be provided with the blocking wall 36 and is to only have the edge 35. Ranges where the dose is higher than the reference dose in FIG. 9 are to be provided with the blocking wall 36 on the edge 35, and the height of the blocking wall 36 in these ranges is varied depending on the dose in each region. Ranges where the dose is lower than the reference dose in FIG. 9 are to be provided with the grooves 37 in the edge 35.

Specifically, in the housing 34*c*, regions RO1 and RO2, which are end regions located at the ends of the light guide plate 34*b*, are to be provided with the grooves 37 in the edge 35, and a region RC of a central region, which is a region other than the end regions, is to be provided with the blocking wall 36 and a region RS of the central region is to only have the edge 35, as illustrated in FIG. 10. The blocking wall 36 in the region RC may have a plurality of levels of height depending on the dose shown in FIG. 9. In the present example, the blocking wall 36 has three levels of height.

The light L that is irradiated onto the photosensitive drum 30 after forming the blocking wall 36 and the grooves 37 having configurations illustrated in FIG. 10 in the housing 34*c* has a dose distribution as shown in FIG. 11. As shown in FIG. 11, the dose of the light L irradiated onto the photosensitive drum 30 from the regions RC and RS is substantially equal to the reference dose, and the dose of the light L from the regions RO1 and RO2 is slightly lower than the reference dose but is close to the reference dose. The configuration described above, in which the regions RO1 are RO2 are provided with the grooves 37 in the edge 35, the region RC is provided with the blocking wall 36 having three levels of height on the edge 35, and the region RS only has the edge 35, allows for a more uniform dose distribution of the light L irradiated onto the photosensitive drum 30, sufficient static elimination, and a reduction in deterioration of the photosensitive drum 30 due to light fatigue.

Embodiment 3

The following describes an image forming apparatus according to Embodiment 3 of the present invention with reference to the drawings. Note that components that have the same function and operation as the components that have already been described are labelled using the same reference signs, and detailed description thereof is omitted.

Figure 12:
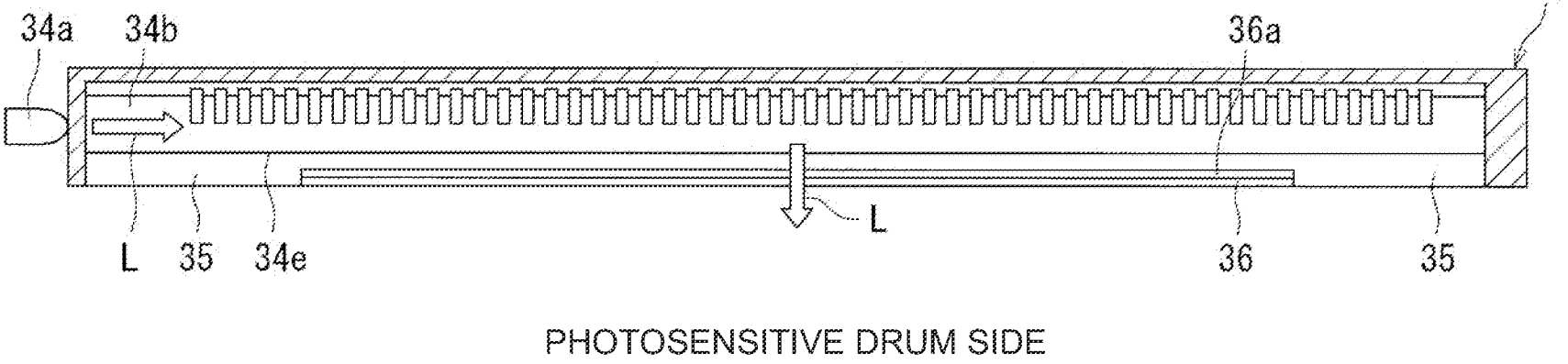
FIG. 12 is a schematic cross-sectional view of a static eliminator in an image forming apparatus according to Embodiment 3 of the present invention.

FIG. 12 is a schematic cross-sectional view of a static eliminator 34 in an image forming apparatus 100 according to Embodiment 3 of the present invention. Embodiment 3 has the same configuration as Embodiment 1 except that a blocking wall 36 in Embodiment 3 is provided with a reflective member 36*a* on a side thereof facing a light guide plate 34*b*.

The blocking wall 36 is provided with the reflective member 36*a* for diffusely reflecting light on the side thereof facing an irradiation end surface 34*e* as illustrated in FIG. 12. As a result, light L emitted from a static elimination light source 34*a* enters the light guide plate 34*b*, is emitted from the irradiation end surface 34*e* of the light guide plate 34*b*, and is then diffusely reflected by the reflective member 36*a* while being restricted by the blocking wall 36. The light L diffusely reflected by the reflective member 36*a* becomes incident on the irradiation end surface 34*e* in a scattered manner. The light L incident on the irradiation end surface 34*e* after having been reflected by the reflective member 36*a* is then reflected by the irradiation end surface 34*e* and emitted from the irradiation end surface 34*e*. As described above, a portion of the light L emitted from the irradiation end surface 34*e* is diffusely reflected by the reflective member 36*a*, and the resulting scattered light is reflected off the irradiation end surface 34*e* and re-emitted from the irradiation end surface 34*e*. Repetition of this cycle allows for a reduction in bright spot unevenness. As a result, it is possible to reduce non-uniform charging on the photosensitive drum 30 and to reduce occurrence of a defect in an image to be formed.

The bright spot unevenness as used herein refers to light being distributed in a non-uniform manner in the longitudinal direction after having been emitted from the light guide plate 34*b* with a Fresnel pitch due to distribution on a Fresnel surface. The bright spot unevenness can make the chargeability of the photosensitive drum 30 non-uniform and cause occurrence of a fringe pattern in an image formed on paper P. However, as a result of providing the reflective member 36*a*, it is possible to reduce the bright spot unevenness and to reduce occurrence of such a defect.

Note that the reflective member 36*a* may have the same shape as the blocking wall 36 and may be a white member. Since it is preferable that the light L be diffusely reflected by the reflective member 36*a*, the reflective member 36*a* preferably has a rough surface rather than a glossy and smooth surface.

The reflective member 36*a* may be provided also on portions of the edge 35 that do not have the blocking wall 36. In this case, the edge 35 may be provided with the reflective member 36*a* directly on a side thereof facing the light guide plate 34*b*. The reflective member 36*a* may extend over the entire length of an opening 34*d* and may be provided on either the side of the edge 35 or the side of the blocking wall 36 facing the light guide plate 34*b*. Alternatively or additionally, the reflective member 36*a* may be provided on an inner surface of the housing 34*c* where the light guide plate 34*b* is disposed. This configuration allows the light L to be further reflected, thereby reducing bright spot unevenness, reducing non-uniform charging on the photosensitive drum 30, and reducing occurrence of a defect in an image to be formed.

The present invention is not limited to the embodiments described above and may be embodied in other specific forms. The foregoing embodiments are therefore to be considered in all respects illustrative rather than limiting the invention described herein. Scope of the present invention is indicated by the appended claims rather than by the foregoing description. All modifications and changes that come within the meaning and range of equivalency of the claims are intended to be embraced within their scope.

What is claimed is:

1. An image forming apparatus comprising:

a photosensitive drum;

a light guide plate that is disposed with a longitudinal direction thereof being substantially parallel to an axial direction of the photosensitive drum and that irradiates, onto the photosensitive drum, static elimination light incoming through an end thereof by emitting the static elimination light from an irradiation end surface thereof, the irradiation end surface of the light guide plate being a surface facing the photosensitive drum;

a light source that emits the static elimination light into the light guide plate, the light source being disposed in the vicinity of the end of the light guide plate; and a blocking member that restricts the static elimination light emitted from the irradiation end surface in a non-uniform manner in the longitudinal direction of the light guide plate, the blocking member being disposed between the light guide plate and the photosensitive drum, and covering the irradiation end surface, wherein the static elimination light emitted from the irradiation end surface includes static elimination light emitted from end regions located around ends of the light guide plate and static elimination light emitted to a central region being a region other than the end regions of the light guide plate, and the static elimination light emitted from the end regions is less restricted by the blocking member than the static elimination light emitted from the central region.

2. The image forming apparatus according to claim 1, wherein the blocking member is a blocking wall having a height that varies according to locations in the longitudinal direction, and being disposed substantially parallel to the axial direction of the photosensitive drum between the light source and the photosensitive drum, and the blocking wall restricts the static elimination light emitted from the irradiation end surface by blocking the static elimination light.

3. The image forming apparatus according to claim 2, wherein the height of the blocking wall is higher in a portion corresponding to the central region than in portions corresponding to the end regions.

4. The image forming apparatus according to claim 3, wherein the blocking wall is stair-like and has a plurality of levels of height, and boundaries between the different levels of height are vertical.

5. The image forming apparatus according to claim 3, wherein the blocking wall is not provided in the end regions.

6. The image forming apparatus according to claim 3, comprising a housing that accommodates the light guide plate therein, the housing having an opening in a side thereof facing the photosensitive drum, wherein the blocking wall is provided on an edge of the opening of the housing, the blocking wall is not provided around ends of the housing, and the edge of the opening has grooves around the ends of the housing to widen the opening.

7. The image forming apparatus according to claim 2, wherein the blocking wall is provided with a reflective member on a surface thereof facing the irradiation end surface, and the reflective member diffusely reflects light.

8. The image forming apparatus according to claim 2, wherein the height of the blocking wall is at a highest level in a location corresponding to a dose peak in a dose distribution of the static elimination light irradiated onto the photosensitive drum from the light source without the blocking wall, and the height of the blocking wall is determined according to the dose distribution.

* * * * *